US007705540B2

(12) United States Patent
Bedynek et al.

(10) Patent No.: US 7,705,540 B2
(45) Date of Patent: Apr. 27, 2010

(54) HIGH-PRESSURE DISCHARGE LAMP HAVING ELECTRICALLY CONDUCTIVE TRANSPARENT COATING

(75) Inventors: Florian Bedynek, Berlin (DE); Michael Bönigk, Berlin (DE); Dirk Grundmann, Berlin (DE); Thomas Reiners, Bachhagel (DE); Conrad Schimke, Berlin (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 1128 days.

(21) Appl. No.: 11/210,878

(22) Filed: Aug. 25, 2005

(65) Prior Publication Data

US 2006/0049764 A1 Mar. 9, 2006

(30) Foreign Application Priority Data

| | | |
|---|---|---|
| Sep. 7, 2004 | (DE) | 10 2004 043 636 |
| Oct. 14, 2004 | (DE) | 10 2004 050 303 |
| Oct. 29, 2004 | (DE) | 10 2004 053 011 |
| Nov. 30, 2004 | (DE) | 10 2004 057 852 |

(51) Int. Cl.
*H01J 17/16* (2006.01)

(52) U.S. Cl. ..... 313/635; 313/634

(58) Field of Classification Search ..... 313/489, 313/634–636

See application file for complete search history.

(56) References Cited

U.S. PATENT DOCUMENTS

| | | | | |
|---|---|---|---|---|
| 4,701,664 A | | 10/1987 | Larue et al. | |
| 4,918,352 A | * | 4/1990 | Hess et al. | 313/25 |
| 5,610,469 A | * | 3/1997 | Bergman et al. | 313/25 |
| 5,702,179 A | * | 12/1997 | Sidwell et al. | 362/255 |
| 5,844,350 A | * | 12/1998 | Scott et al. | 313/25 |
| 6,153,982 A | | 11/2000 | Reiners | |
| 6,456,005 B1 | | 9/2002 | Panchula et al. | |
| 6,894,429 B2 | * | 5/2005 | Tsuda et al. | 313/318.09 |
| 2001/0041491 A1 | | 11/2001 | Nishida | |

FOREIGN PATENT DOCUMENTS

| | | |
|---|---|---|
| DE | 717783 | 2/1942 |
| EP | 0 991 107 | 4/2000 |
| EP | 1 369 902 | 12/2003 |
| GB | 1012574 | 12/1965 |
| JP | 06060851 A | 3/1994 |
| WO | WO 91/18413 | 11/1991 |

OTHER PUBLICATIONS

English language abstract for JP 06060851 A.

* cited by examiner

*Primary Examiner*—Bumsuk Won

(57) ABSTRACT

The invention relates to a high-pressure discharge lamp having a transparent discharge vessel, an ionizable filling which is arranged in the discharge space of the discharge vessel and electrodes, which extend into the discharge space of the discharge vessel, for the purpose of producing a gas discharge, as well as power supply lines, which are passed out of the discharge vessel, for the purpose of supplying energy to the electrodes, the discharge vessel of the high-pressure discharge lamp being provided partially with an electrically conductive coating, with the result that a capacitive coupling is produced between the coating and at least one electrode and/or power supply line. As a result, the starting properties and the luminous efficiency of the lamp are improved.

6 Claims, 3 Drawing Sheets

HIGH-PRESSURE DISCHARGE LAMP HAVING ELECTRICALLY CONDUCTIVE TRANSPARENT COATING

I. TECHNICAL FIELD

Figure 1:
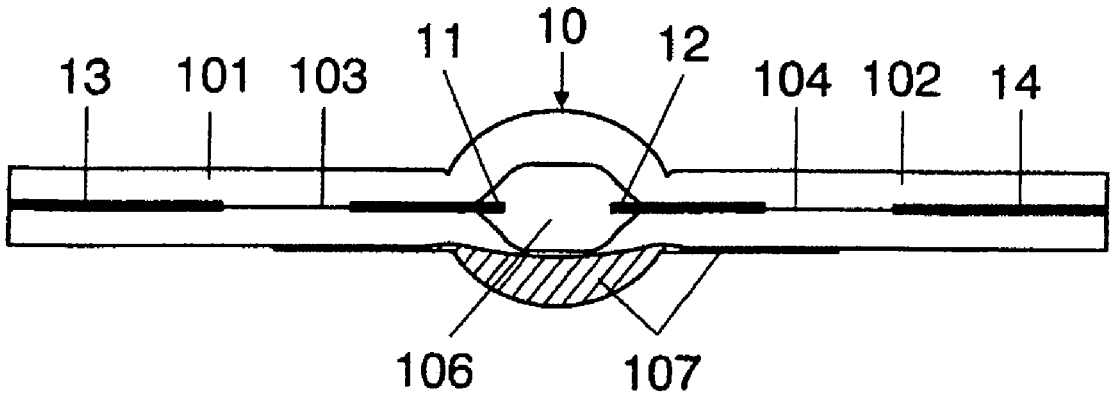

The invention relates to a high-pressure discharge lamp having a transparent discharge vessel, an ionizable filling which is arranged in the discharge space of the discharge vessel and electrodes, which extend into the discharge space of the discharge vessel, for the purpose of producing a gas discharge, as well as power supply lines, which are passed out of the discharge vessel, for the purpose of supplying energy to the electrodes, the high-pressure discharge lamp having an electrically conductive, transparent layer.

II. BACKGROUND ART

Such a high-pressure discharge lamp has been disclosed, for example, in the European patent specification EP 0 991 107 B1. On page 4, at lines 12 to 26 of column 6 of this patent specification, a high-pressure discharge lamp with a base at one end for a motor vehicle headlight is described which has a discharge vessel surrounded by a vitreous outer bulb, the outer bulb being provided with a transparent, electrically conductive layer which extends over the entire discharge space of the lamp. This layer is connected to the circuit-internal ground reference potential of the operating device of the high-pressure discharge lamp in order to improve the electromagnetic compatibility of the lamp.

III. DISCLOSURE OF THE INVENTION

It is the object of the invention to provide a high-pressure discharge lamp, in particular a mercury-free halogen metal-vapor high-pressure discharge lamp for vehicle headlights having an improved starting capacity.

This object is achieved according to the invention by a high-pressure discharge lamp having a transparent discharge vessel, an ionizable filling which is arranged in the discharge space of the discharge vessel and electrodes, which extend into the discharge space of the discharge vessel, for the purpose of producing a gas discharge, as well as power supply lines, which are passed out of the discharge vessel, for the purpose of supplying energy to the electrodes, the high-pressure discharge lamp having an electrically conductive, transparent layer, wherein said electrically conductive, transparent layer is in the form of an at least partial coating of the surface of the discharge vessel, with the result that a capacitive coupling is produced between the coating and at least one electrode and/or power supply line. Particularly advantageous embodiments of the invention are described in the dependent patent claims.

The high-pressure discharge lamp according to the invention has a transparent discharge vessel, an ionizable filling which is arranged in the discharge space of the discharge vessel and electrodes, which extend into the discharge space of the discharge vessel, for the purpose of producing a gas discharge, as well as power supply lines, which are passed out of the discharge vessel, for the purpose of supplying energy to the electrodes, the surface of the discharge vessel being provided at least partially with a transparent, electrically conductive coating, with the result that a capacitive coupling is produced between the coating and at least one electrode and/or power supply line. The abovementioned coating forms, together with the at least one electrode and possibly with the associated power supply line, a capacitor, the quartz glass, lying therebetween, of the discharge vessel and the filling gas in the discharge space forming the dielectric of this capacitor. As a result, in particular with the aid of the radiofrequency components of the starting pulse, a dielectrically impeded discharge is produced in the discharge space between the at least one electrode and the coating. This dielectrically impeded discharge generates a sufficient number of free charge carriers in the discharge space to make possible the electrical flashover between the two electrodes of the high-pressure discharge lamp and to markedly reduce the starting voltage required for this purpose. The invention is therefore particularly well suited to mercury-free halogen metal-vapor high-pressure discharge lamps which have an increased starting voltage owing to the absence of mercury.

Figure 5:
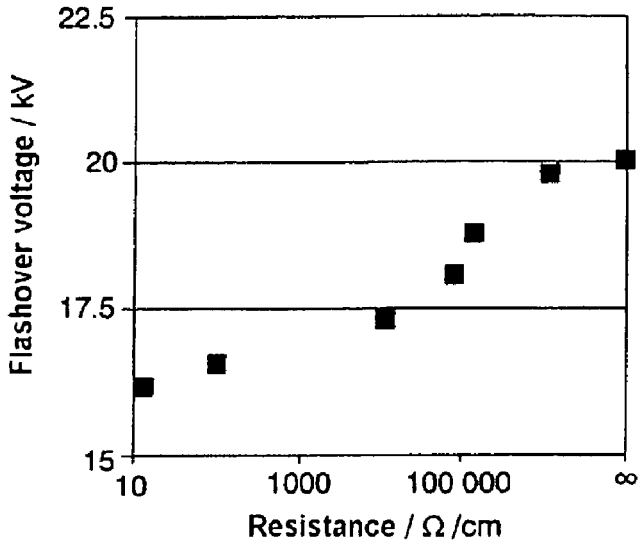

FIG. 5 illustrates the dependence of the flashover voltage of the discharge path on the resistance of the partial coating according to the invention for several mercury-free halogen metal-vapor high-pressure discharge lamps (depicted schematically in FIG. 3) having a power rating of 35 watts which have been provided with a partial coating of varying thickness. The resistance of the coating is plotted on the horizontal axis using the unit ohms/cm as a logarithmic scale, and the flashover voltage of the discharge path of the lamp is plotted on the vertical axis in kilovolts. The resistance was measured between two points of the coating arranged at a distance of 1 cm from one another. It can clearly be seen that, in lamps of this type, whose partial coating has a resistance of less than or equal to $10^5$ ohms/cm, the discharge path has a significantly reduced flashover voltage. The thickness of the partial coating according to the invention is therefore selected such that its resistance per length unit is in the range of order of magnitude of $10^3$ ohms/cm to $10^5$ ohms/cm. In the case of a resistance below $10^3$ ohms/cm, the layer thickness is so great that it can have a negative effect on the optical properties of the headlight system owing to light reflection. In accordance with the particularly preferred exemplary embodiment of the invention, the layer thickness is selected such that its resistance per length unit is of the order of magnitude of $10^4$ ohms/cm. The flashover voltage of the discharge path has in this case been reduced from 20 kV in the case of uncoated lamps to approximately 17.5 kV. Owing to the coating according to the invention, the required starting voltage is therefore correspondingly reduced.

The transparent, electrically conductive coating is advantageously applied to the outer surface of the discharge vessel since it is not subjected there to chemical attack by the metal halides and to the discharge plasma. The abovementioned coating is arranged at least in the region of the discharge space and extends over part of the circumference of the discharge space in order to ensure effective capacitive coupling of the coating to at least one electrode and preferably even to both electrodes owing to the large-area extent of the coating.

In order to optimize the abovementioned capacitive coupling, in the case of high-pressure discharge lamps having power supply lines which comprise at least one molybdenum film embedded in the material of the discharge vessel, the transparent, electrically conductive partial coating is designed such that it extends up to the at least one molybdenum film and one of the two sides of the molybdenum film faces the coating. As a result, the molybdenum film and the coating form a type of capacitor plate, the material of the discharge vessel arranged therebetween, preferably quartz glass, forming the dielectric of this capacitor.

In the case of high-pressure discharge lamps which are envisaged for operation in the horizontal position, i.e. with electrodes arranged on a horizontal plane, the transparent, electrically conductive coating is advantageously restricted to a surface region of the discharge vessel which is arranged beneath the electrodes. The coating reflects some of the infrared radiation generated by the discharge back into the discharge space and thus provides for selective heating of the colder regions of the discharge vessel which lie beneath the electrodes and in which the metal halides used for light generation accumulate. As a result, the efficiency of the lamp can be increased without likewise heating the hot regions of the discharge vessel which lie above the electrodes. In addition, the application of the coating only to the colder underside of the discharge vessel reduces the thermal load on the coating, with the result that correspondingly lower demands can be placed on the thermal rating of the coating materials.

Figure 6:
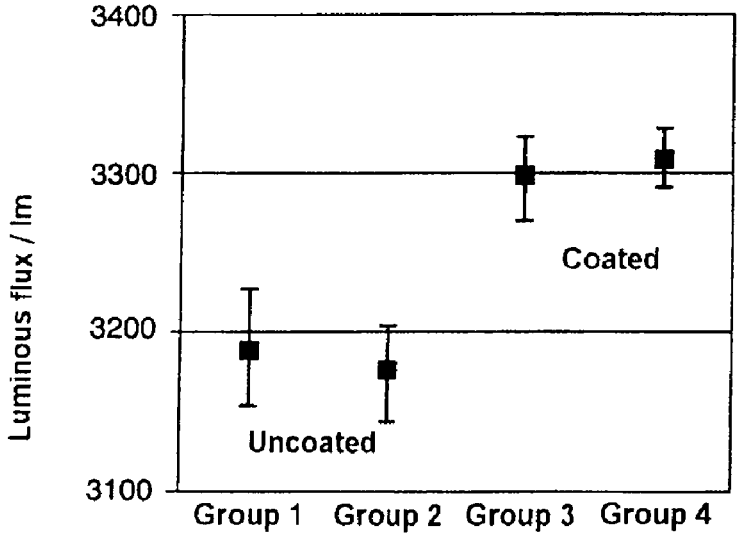

FIG. 6 illustrates the luminous flux, measured in the unit lumens, for two production charges of uncoated, mercury-free halogen metal-vapor high-pressure discharge lamps operated in a horizontal operating position and having a power rating of 35 watts (group 1 and group 2) in comparison with two production charges of mercury-free halogen metal-vapor high-pressure discharge lamps according to the invention, which are provided with the abovementioned coating and are operated in the horizontal operating position, having a power rating of 35 watts (group 3 and group 4). The lamps in groups 3 and 4 were aligned horizontally during operation such that the coating according to the invention was arranged beneath the electrode connecting axis. These lamps have the design illustrated schematically in FIG. 3. Their coating had a resistance per length unit of the order of magnitude of $10^4$ ohms/cm. It can be seen from FIG. 6 that the lamps according to the invention in groups 3 and 4 have a higher luminous flux and thus a higher luminous efficiency than the uncoated lamps in groups 1 and 2.

In addition, the lamps according to the invention in groups 3 and 4 also have another advantage over the uncoated lamps in groups 1 and 2. As can be seen from FIG. 7, the lamps according to the invention in groups 3 and 4 have a higher operating voltage than the uncoated lamps in groups 1 and 2. As a result, with the lamps according to the invention a correspondingly lower lamp current is required during lamp operation in order to reach the desired power rating of 35 watts. Correspondingly, the operating devices can be dimensioned for lower current levels.

In accordance with the preferred exemplary embodiment of the invention, the high-pressure discharge lamp is in the form of a high-pressure discharge lamp having a base at one end, the discharge vessel of said high-pressure discharge lamp having a sealed end near to the base and a sealed end remote from the base, in each case a power supply line for the electrodes being passed out of said ends, the power supply line which is passed out of the end remote from the base being connected to a power return line which is passed back to the base. In the case of this high-pressure discharge lamp, the transparent, electrically conductive coating is arranged on a surface region of the discharge vessel which faces the power return line owing to the above explanations and the fact that this lamp is operated in the horizontal position with the power return line extending beneath the electrodes. The abovementioned coating in this high-pressure discharge lamp is preferably delimited on a surface region of the discharge vessel which is arranged between the power return line and the connecting axis of the electrodes and extends in the longitudinal direction of the lamp at least over part of the discharge space and part of one of the two ends of the discharge vessel. The surface region of the discharge vessel which faces the power return line plays only a subordinate role when using the high-pressure discharge lamp in a vehicle headlight for producing the desired light distribution. A slight light absorption caused by the coating is therefore also insignificant.

The high-pressure discharge lamp according to the invention is advantageously provided, for reasons of safety, with a transparent outer bulb which surrounds at least the discharge space of the discharge vessel. The glass of the outer bulb is doped with means for absorbing ultraviolet radiation in order to absorb the UV radiation emitted by the gas discharge.

The intermediate space between the outer bulb and the discharge vessel is advantageously provided with a gas filling which has a coldfilling pressure in the range from 5 kPa to 150 kPa. In this case, coldfilling pressure means the filling pressure measured at a temperature of the gas filling of 22 degrees Celsius. Owing to the gas filling, gaseous impurities, such as water vapor and carbon dioxide as well as combustion gases which have formed during sealing of the lamp vessel, and the temperature gradient along the discharge vessel are reduced.

The abovementioned gas filling advantageously contains inert gases which do not undergo any chemical reaction with the material of the coating according to the invention on the discharge vessel. The gas filling therefore preferably contains nitrogen or at least one noble gas. In addition, the gas filling advantageously contains small amounts of oxygen in order to counteract diffusion of oxygen from the coating which is preferably formed as a doped tin oxide layer or ITO layer on the discharge vessel.

IV. BRIEF DESCRIPTION OF THE DRAWINGS

Figure 2:
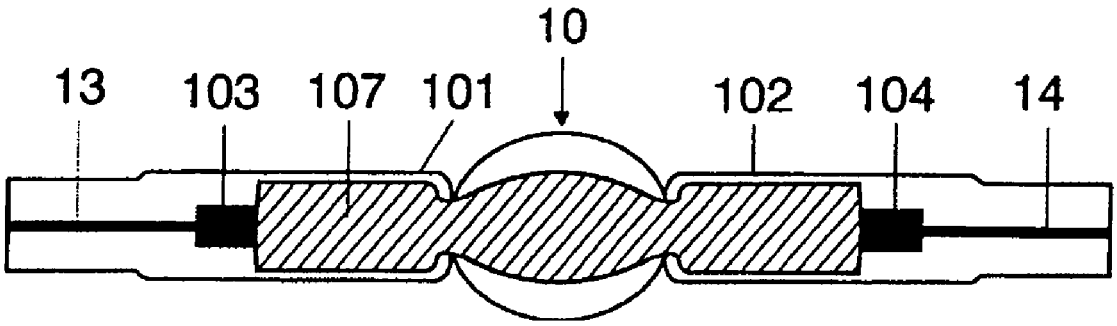
Figure 4:
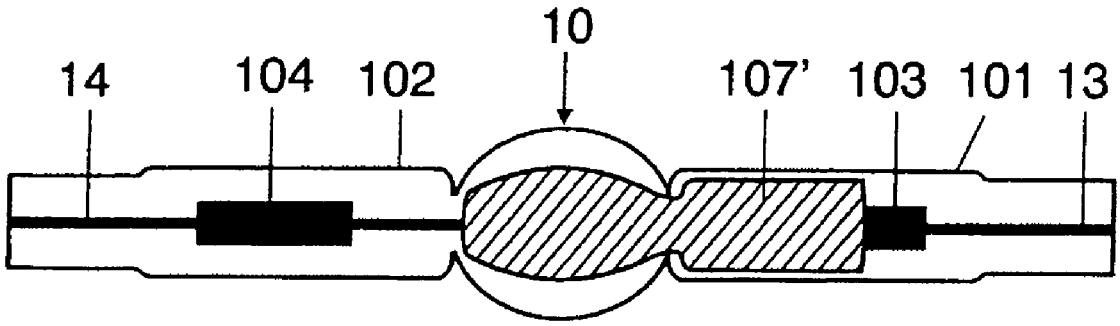
Figure 3:
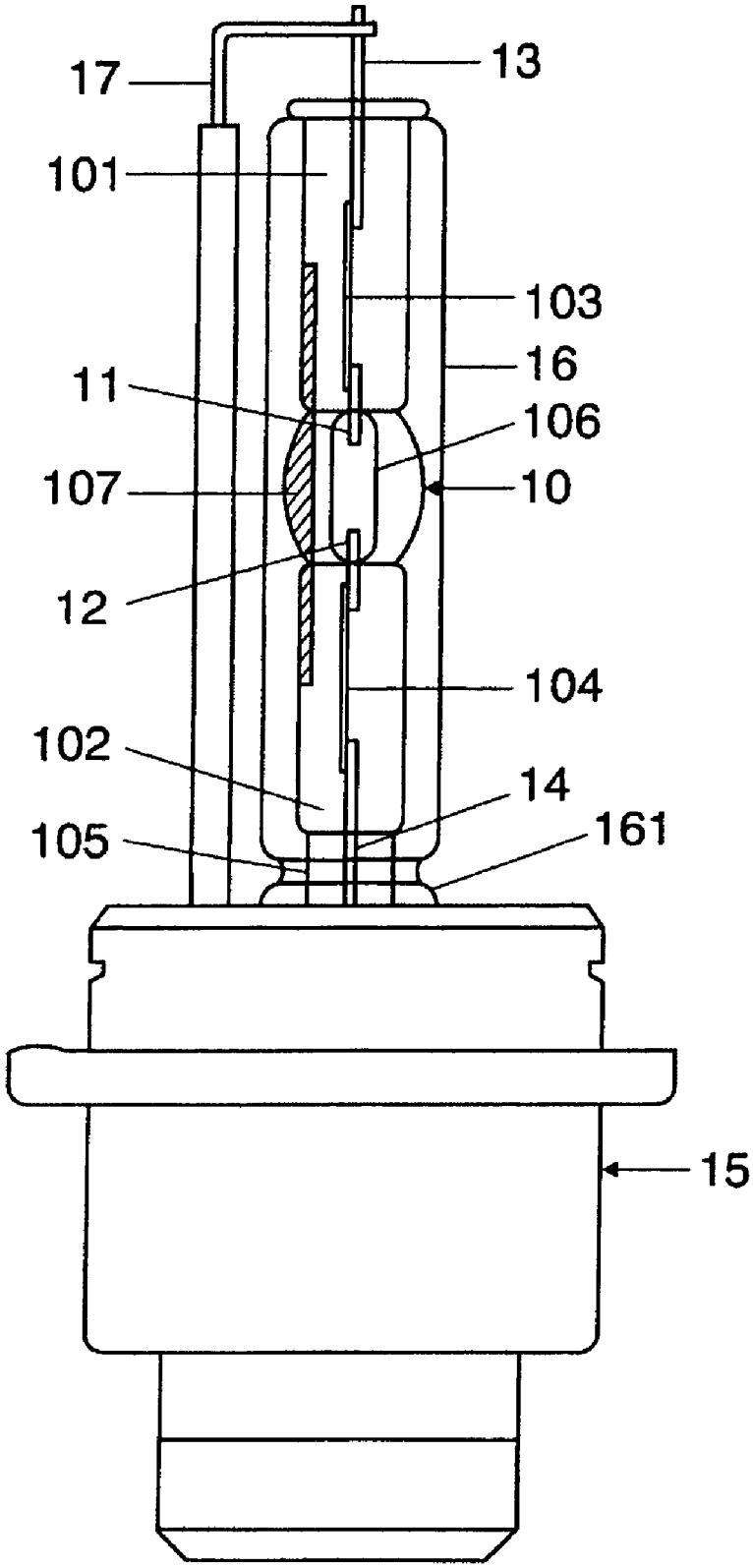
Figure 7:
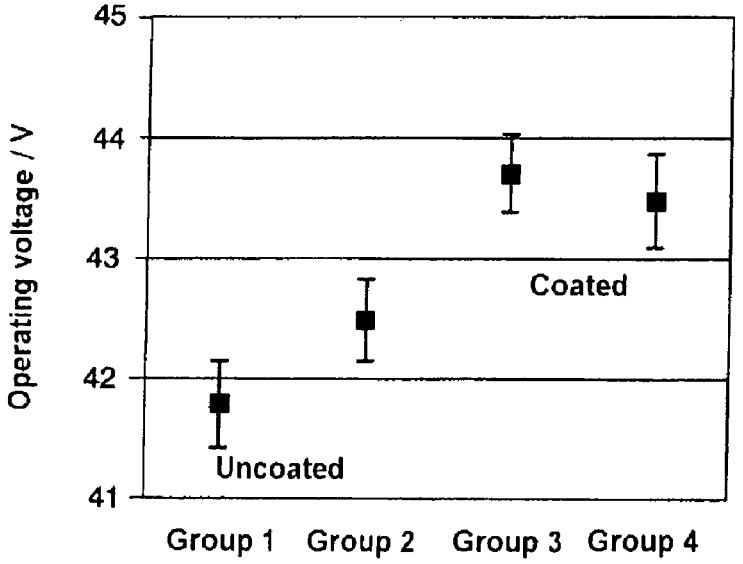

The invention will be explained in more detail below with reference to a preferred exemplary embodiment. In the drawings:

FIG. 1 shows a side view of the discharge vessel of the high-pressure discharge lamp depicted in FIG. 3 in accordance with the preferred exemplary embodiment, FIG. 2 shows a side view of the discharge vessel of the high-pressure discharge lamp depicted in FIG. 3 in accordance with the preferred exemplary embodiment in a view which is rotated through an angle of 90 degrees with respect to FIG. 1, FIG. 3 shows a side view of the high-pressure discharge lamp in accordance with the preferred exemplary embodiment of the invention, FIG. 4 shows a side view of the discharge vessel of the high-pressure discharge lamp depicted in FIG. 3 having an alternative coating, FIG. 5 shows the dependence of the flashover voltage of the discharge path on the resistance of the partial coating, FIG. 6 shows the measured luminous flux for two production charges of uncoated high-pressure discharge lamps and two production charges of high-pressure discharge lamps which have been coated according to the invention, and FIG. 7 shows the operating voltage of two production charges of uncoated high-pressure discharge lamps and of two production charges of high-pressure discharge lamps which have been coated according to the invention.

V. BEST MODE FOR CARRYING OUT THE INVENTION

The preferred exemplary embodiment of the invention illustrated schematically in FIG. 3 is a mercury-free halogen metal-vapor high-pressure discharge lamp having an electrical power consumption of approximately 35 watts. This lamp is envisaged for use in a vehicle headlight. It has a discharge vessel 30 made from quartz glass which is sealed at two ends and has a volume of 24 $mm^3$, in which an ionizable filling, comprising xenon and halides of the metals sodium, scandium, zinc and indium, is enclosed in a gas-tight manner. In the region of the discharge vessel 106, the inner contour of the discharge vessel 10 is circular-cylindrical, and its outer contour is ellipsoidal. The internal diameter of the discharge space 106 is 2.6 mm and its external diameter is 6.3 mm. The two ends 101, 102 of the discharge vessel 10 are each sealed by means of a fused molybdenum foil seal 103, 104. Located in the interior of the discharge vessel 10 are two electrodes 11, 12, between which the discharge arc responsible for the light emission is formed during operation of the lamp. The electrodes 11, 12 are made from tungsten. Their thickness or their diameter is 0.30 mm. The distance between the electrodes 11, 12 is 4.2 mm. The electrodes 11, 12 are each electrically conductively connected to an electrical connection of the essentially plastic lamp base 15 via one of the fused molybdenum foil seals 103, 104 and via the power supply wire 13 remote from the base and the power return line 17 or via the base-side power supply wire 14. The discharge vessel 10 is surrounded by a vitreous outer bulb 16. The outer bulb 16 has a protrusion 161 anchored in the base 15. The discharge vessel 10 has a tubular extension 105 made from quartz glass on the base side in which the base-side power supply line 14 extends.

The surface region of the discharge vessel 10 which faces the power return line 17 is provided with a transparent, electrically conductive coating 107. This coating 107 extends in the longitudinal direction of the lamp over the entire length of the discharge space 106 and over part, approximately 50 percent, of the length of the sealed ends 101, 102 of the discharge vessel 10. The coating 107 is applied to the outside of the discharge vessel 10 and extends over approximately 5 percent to 10 percent of the circumference of the discharge vessel 10. FIGS. 1 and 2 show two different views of the discharge vessel 10 and of the coating 107 of the high-pressure discharge lamp depicted in FIG. 3. The coating 107 in this case covers in symmetrical fashion the two ends 101, 102 of the discharge vessel 10. The coating 107 is made from doped tin oxide, for example from tin oxide doped with fluorine or antimony or for example from tin oxide doped with boron and/or lithium. This high-pressure discharge lamp is operated in the horizontal position, i.e. with electrodes 11, 12 arranged on a horizontal plane, the lamp being aligned such that the power return line 17 extends beneath the discharge vessel 30 and the outer bulb 16.

The intermediate space between the outer bulb 16 and the discharge vessel 10 is filled with an inert gas having a cold-filling pressure in the range from 5 kPa to 150 kPa. Small amounts of oxygen are admixed to the inert gas. The oxygen content is set such that, on the one hand, diffusion of oxygen from the tin oxide layer 107 is prevented and, on the other hand, no oxidation of the dopants in the tin oxide coating 107 is caused. A few ppm of oxygen content, for example 100 ppm (by weight) of oxygen content, are already sufficient for this purpose. The inert gas is preferably nitrogen or a noble gas or a noble gas mixture or a nitrogen/noble gas mixture.

FIG. 4 shows the discharge vessel 10 of the high-pressure discharge lamp depicted in FIG. 3 having an alternative coating 107'. The coating 107' differs from the above-described coating 107 only in the fact that the coating 107' extends in the longitudinal direction of the lamp only over the length of the discharge space 106 and approximately 50 percent of the length of that end 101 of the discharge vessel 10 which is near to the base.

The invention is not restricted to the exemplary embodiments explained in more detail above. Instead of the above-mentioned material, the coating 107 may also be made from another transparent, electrically conductive material. For example, it may be in the form of a so-called ITO layer, i.e. an indium/tin/oxide layer. The ITO layer may have, for example, 90 percent by weight of indium oxide and 10 percent by weight of tin oxide. In addition, the coating 107 or 107' may be electrically coupled to a starting device, for example using suitable means, in order to apply voltage pulses to the high-pressure discharge lamp via the coating 107, 107' for the purpose of starting the gas discharge in the discharge space 106. The invention may furthermore also be used for the conventional mercury-containing halogen metal-vapor high-pressure discharge lamps in order to achieve the above-described advantages. In addition, the coating 107 or 107' may extend over the entire surface of the discharge vessel 10. However, it is also possible for the coating 107 or 107' to extend, for example, only over half or a third of the circumference of the discharge vessel 10 in the region of the discharge space 106. In the region of the ends 101, 102 of the discharge vessel 10, the coating 107 or 107' may extend, for example, over the entire circumference of the discharge vessel 10 or else only over a third, half or another fraction of the discharge vessel circumference. However, it is also possible for no transparent, electrically conductive coating of the discharge vessel 10 to be provided in the region of the ends 101, 102. The coating 107 or 107' is preferably designed such that it acts as a starting aid and serves the purpose of heating the coldest point on the discharge vessel, the so-called cold spot. The electrical resistance of the transparent coating 107 or 107' is in the range from 40 000 ohms to 200 000 ohms.

What is claimed is:

1. A high pressure discharge lamp comprising a transparent discharge vessel, an ionizable filling and electrodes, the ionizable filling arranged in the discharge space of the discharge vessel, and the electrodes arranged to extend into the discharge space of the discharge vessel, for the purpose of producing a gas discharge, the lamp further comprising a base arranged at an end of the high pressure discharge lamp, wherein said discharge vessel comprises a proximate sealed end which is arranged near to the base and a distal sealed end which is arranged remotely from the base, wherein a power supply line is passed out of each of the afore-said sealed ends of the discharge vessel, for the purpose of supplying energy to the electrodes, and the power supply line which is passed out of said distal sealed end is connected to a power return line which is passed back to said base, and the lamp further comprising an electrically conductive transparent layer which is in the form of a partial coating on the outer surface of the discharge vessel, with the result that a capacitive coupling is produced between the said partial coating and at least one of the electrodes and at least one of the power supply lines, said partial coating being arranged on a region of the outer surface of the discharge vessel which faces said power return line and extending over part of the circumference of the discharge space, and wherein said at least one power supply line comprises at least one molybdenum foil embedded in a material of the discharge vessel, and said partial coating extends up to the at least one molybdenum foil of said at least one power supply line, wherein said at least one molybdenum foil is oriented such that one of two sides of said at least one molybdenum foil faces said partial coating.

2. The high-pressure discharge lamp as claimed in claim 1, wherein said partial coating is made from doped tin oxide.

3. The high-pressure discharge lamp as claimed in claim 1, wherein the high-pressure discharge lamp is provided with a transparent outer bulb which surrounds at least the discharge space of the discharge vessel.

4. The high-pressure discharge lamp as claimed in claim 3, wherein the intermediate space between the outer bulb and the discharge vessel is provided with a gas filling which has a coldfilling pressure in the range from 5 kPa to 150 kPa.

5. The high-pressure discharge lamp as claimed in claim 4, wherein said gas filling contains nitrogen or at least one noble gas.

6. The high-pressure discharge lamp as claimed in claim 5, wherein said gas filling also contains oxygen.

* * * * *